United States Patent [19]

Kim

[11] Patent Number: 4,780,016

[45] Date of Patent: Oct. 25, 1988

[54] CAPTIVE PEN CAP

[76] Inventor: Jae H. Kim, 24 Coachman La., Natick, Mass. 01760

[21] Appl. No.: 34,908

[22] Filed: Apr. 6, 1987

[51] Int. Cl.[4] ..... B43K 9/00

[52] U.S. Cl. ..... 401/117; 401/91; 401/116

[58] Field of Search ..... 401/116, 117, 91

[56] References Cited

U.S. PATENT DOCUMENTS

| | | | |
|---|---|---|---|
| 454,623 | 6/1891 | Baumgarten | 401/91 |
| 856,148 | 10/1907 | Levingston | 401/91 |
| 1,156,860 | 10/1915 | Heylmun | 401/91 |
| 1,355,026 | 10/1920 | Austin | 401/117 |
| 1,476,107 | 12/1923 | Rudderham | 401/116 X |
| 2,435,185 | 1/1948 | Reynolds | 401/117 |
| 2,603,186 | 7/1952 | Fisher | 401/116 |
| 2,941,511 | 6/1960 | Cieremans | 401/116 |
| 2,952,242 | 9/1960 | Rosso | 120/42.03 |
| 4,080,078 | 3/1978 | Halm | 401/117 X |
| 4,529,328 | 7/1985 | Wacha et al. | 401/117 |

*Primary Examiner*—Steven A. Bratlie

*Attorney, Agent, or Firm*—Lahive & Cockfield

[57] ABSTRACT

A cap for the point of a pen or pencil includes a cap element that is affixed to the writing end of, and captive on, the pen or pencil. The cap is rotatably and slideably moveable between a first extended position for covering and protecting the point, and alternately, a second, retracted position in which the cap element moves further onto the pen or pencil to expose the point for writing.

1 Claim, 1 Drawing Sheet

CAPTIVE PEN CAP

BACKGROUND OF THE INVENTION

This invention relates generally to pen caps and, more particularly, to a pen cap which in one position covers the point of the pen, and in a second position exposes the point of the pen for writing.

Pens have employed a variety of cap structures for providing protection for the pen point. The following U.S. patents illustrate developments in sliding caps for pencils, pens and the like.

U.S. Pat. No. 454,623 Baumgarten
U.S. Pat. No. 856,148 Levingston
U.S. Pat. No. 1,156,860 Heylmun
U.S. Pat. No. 1,355,026 Austin
U.S. Pat. No. 2,952,242 Rosso Baumgarten (U.S. Pat. No. 454,623), for example, discloses a telescoping sleeve which protects the point of a pencil or pen. A slot is provided for sliding engagement with a retaining stud, and the sleeve is pushed into its retracted and covering positions. Levingston (U.S. Pat. No. 856,148) discloses a similar device in which a slidable cover sleeve engages an inner sleeve that is retained to the pencil by spring pressure. The cover sleeve is slid forward to protect the pencil point, or retracted to expose the point for writing.

Utilizing a pen to generate precise written characters requires that movement of the writer's hand be exactly communicated to the point of the pen. There must be no slop or lost motion between the pen point and the grip surface which the user grasps to hold the pen and direct the pen point.

Prior art cap structures, however, provide an imprecise, sloppy connection between the grip surface and the barrel of the pen when in the retracted position. Pens incorporating such cap structures cannot be readily utilized for precise writing.

Additionally, a pen should be comfortable to use. Prior art cap structures add considerable bulk to the grip area of the pen, and this bulk, combined with exposed projections and slot edges common to prior art pen caps, makes pens incorporating such cap structures uncomfortable to use.

It is accordingly an object of the invention to provide a cap structure which is captive on a pen, and which is moveable between two positions, namely a forward position which protects the point, and a rearward or retracted position which exposes the point for writing.

It is a further object of the invention to provide a cap structure which in its retracted position has a precise connection between the grip surface and the pen barrel, so that the pen can be utilized for precise writing.

It is yet another object of the invention to provide a cap structure which avoids excessive bulk, and which has a comfortable grip surface without exposed projections or slot edges.

It is still another object of the invention to provide a cap structure which is simple and inexpensive to manufacture, and which is readily adaptable to existing pen products such as common disposable pens.

Other general and specific objects of the invention will in part be obvious and will in part appear hereinafter.

SUMMARY OF THE INVENTION

The invention provides a cap for the point of a pen or pencil, and having a cap element that is affixed to the writing end of and captive on the pen. The cap is rotatably and slidably moveable between a first extended position for covering and protecting the point, and alternately, a second, retracted position in which the cap element moves further onto the pen to expose the point for writing with the pen.

The invention further discloses a pen cap structure wherein the pen includes a plurality of captive barbs in the area of engagement with the cap, and wherein the cap element incorporates a substantially helical internal thread which threadedly engages the plurality of barbs on the pen so that rotation of the cap element relative to the pen results in longitudinal movement of the cap element between the first and the second positions.

The invention also discloses a pen cap wherein the internal thread describes approximately one full turn about the cap, the thread being pitched so that rotating the cap element relative to the pen by approximately one full turn results in the cap element moving between the two operative positions.

A further aspect of the invention is a pen cap structure wherein the cap element includes a rear internal lip around its periphery, and wherein the pen includes a collar-like seat on which the back internal lip of the cap firmly seats when in the retracted position, so that the cap, when in the retracted position, firmly seats on the shoulder of the pen. This firm engagement enables a user to hold the pen, for writing, by grasping the cap.

The invention accordingly comprises the apparatus embodying features of construction, combinations of elements and arrangements of parts as exemplified in the following detailed disclosure, and the scope of the invention is indicated in the claims.

BRIEF DESCRIPTION OF THE DRAWINGS

For a fuller undertanding of the nature and objects of the invention, reference should be made to the following detailed description and the accompanying drawings, in which.

Throughout this description, like reference characters in respective drawing figures are used to indicate corresponding parts.

DESCRIPTION OF ILLUSTRATED EMBODIMENTS

Figure 1:
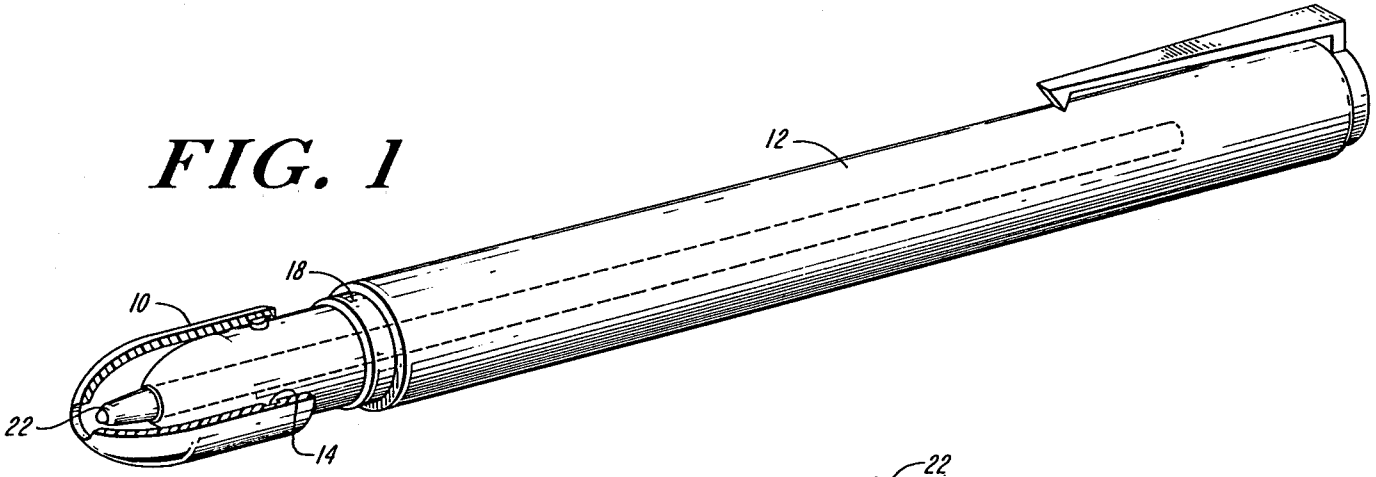
FIG. 1 is a perspective view of a pen incorporating a pen cap structure according to the invention, showing the cap element in a position covering the pen point.

FIG. 1 is a perspective view of a pen cap according to the invention. Cap element 10 has formed therein a front opening sized to admit the point 22 of a pen 12, and has internal helical slots or threads **14*a* and 14*b*. Cap element 10 preferably has a substantially conical shape. Slots 14*a* and 14*b* engage a plurality of projecting barbs or guides 16 which are incorporated into the barrel of the pen 12 proximate to the end nearest the point 22. The slots 14*a* and 14*b* terminate near the rear edge of cap element 10, proximate to a rear lip 20 formed around the periphery of cap element 10. As a consequence of this rear termination of threads 14***a* and 14*b*, cap element 10 is captive on the pen 12, and cannot be inadvertently lost.

The pen cap structure also includes a shoulder element 18 incorporated into the barrel of pen 12. The shoulder element 18 is a raised area surrounding the barrel of pen 12 in the region proximate to the guides 16. When cap element 10 is in its second, retracted position, cap element 10 seats on shoulder element 18 in a manner more fully described hereinafter in connection with FIG. 2.

In FIG. 1, cap element 10 is shown in a first position covering the point 22 of pen 12. In this position, point 22 is protected from damage, and the pen may be carried, for example, in a shirt pocket without fear of point 22 catching upon and damaging the fabric of the pocket.

In order to expose the point 22 of pen 12, the user rotates cap element 10. Because of the engagement of the pitched helical slots 14*a* and 14*b* with the guides 16, as cap element 10 rotates, the guides 16 contact successive portions of the slots 14*a* and 14*b*. This causes cap 10 to move longitudinally. Thus, as shown in FIG. 1, when cap 10 is rotated in one direction, cap 10 moves toward its first, covering position, and its travel is arrested by guides 16 contacting the rearward ends of slots 14*a* and 14*b*. When cap 10 is rotated in the opposite direction, cap 10 moves toward its second, retracted position for writing, and point 22 protrudes through the front end opening in cap element 10. See FIG. 2.

Figure 2:
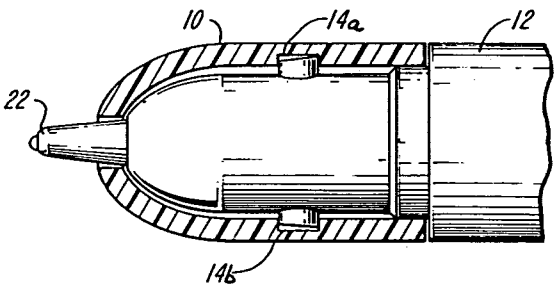
FIG. 2 is a fragmentary sectional view of the pen cap structure of FIG. 1, showing the cap element in a position exposing the pen point.

When cap 10 is rotated in this latter direction, its travel is arrested when rear lip portion 20 seats on shoulder element 18. This is illustrated in FIG. 2. Rear lip portion 20 and shoulder element 18 preferably form an interference fit, so that when cap element 10 is rotated into its second, retracted position, there is no clearance or slop between the cap 10 and the barrel of pen 12, and there is no clearance between the rear surface of lip 20 and the lip of the barrel of pen 12. This feature allows the cap to be used as a grip surface when in the retracted position, and eliminates lost motion or imprecision between the grip surface and point 22 when writing. A pen incorporating a pen cap structure according to the invention can thus be utilized for precise writing.

Figure 3B:
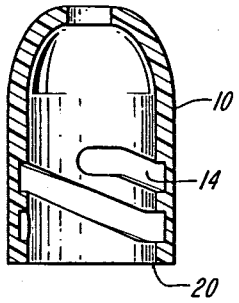
FIG. 3B is a sectional view of a cap element according to the invention, giving detail of the internal helical slot.
Figure 3A:
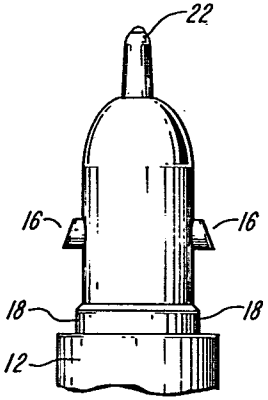
FIG. 3A is a fragmentary perspective view of a pen adapted for use with the invention.

FIG. 3A gives detail of the illustrated pen 12 as adapted for use with a pen cap structure according to the invention. In a preferred embodiment of the invention, guides 16 and shoulder element 18 are formed integrally with the barrel of pen 12, as by conventional molding techniques employed in the manufacture of common disposable pens. It will be seen that only minimal modification to existing pen designs is required to practice the invention.

Guides 16 preferably beveled approximately thirty degrees. This feature permits the cap 10 to be slipped over the guides 16 during manufacture, while allowing guides 16 to securely retain cap 10 once the pen is assembled.

FIG. 3B gives detail of the structure of the illustrated cap element 10. Cap element 10 may be composed of the same materials that are used in the fabrication of pen 12. In a preferred embodiment of the invention, helical slots 14*a* and 14*b* describe a three-fourth turn about the interior of cap 10, and the slots 14*a* and 14*b* are pitched so that rotating cap element 10 a three-fourth turn causes cap element 10 to move from one operative position to the other.

In a further preferred embodiment of the invention, helical slots 14*a* and 14*b* describe a full turn about the interior of cap 10, and the slots 14*a* and 14*b* are pitched so that rotating cap element 10 one full turn causes cap element 10 to move from one operative position to the other.

It will be noted that the minimal bulk presented by the cap, and the absence of exposed projections or slot edges, renders a pen 12 incorporating the cap structure comfortable and convenient to use. It will also be noted that the invention may be practiced in an embodiment in which helical slots are incorporated into the forward portion of the pen barrel, and corresponding guides incorporated into the cap.

Thus one feature of the invention is a pen cap that is captive on the pen, so that it cannot be lost, a pen cap that is moveable between two positions for covering and protecting the point, and alternatively for exposing the point for writing.

A second feature is that the cap, when in the retracted position, firmly seats on a shoulder 18 on the pen. That is, the pen has a collar-like seat 18 on which the back internal lip 20 of the cap firmly seats when in the retracted position. The firm engagement enables a user to hold the pen, for writing, by grasping the cap.

It will thus be seen that the invention efficiently attains the objects set forth above, among those made apparent from the preceding description. It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A cap structure for the point of a pen, comprising:

A. a cap element, said cap element including (i) a forward end opening formed therein, (ii) a rearward end opening formed therein, (iii) a plurality of helical internal slots, said slots describing no more than one turn about said cap element, said slots terminating rearwardly in rearward terminations at selected points forward of said rearward end opening of said cap element, and (iv) a rear lip disposed about the periphery of said cap element opposite said forward end opening, B. means for mounting said cap element to said pen for rotatable and longitudinal movement from a first position covering said point to a second, retracted position exposing said point for writing, said mounting means including a plurlaity of radially protruding barbs affixed to said pen proximate to said cap element and engaging said slots in said cap element so that rotation of said cap element causes said protruding barbs to contact successive portions of said helical slots, causing said cap element to move longitudinally, to said first covering position covering said point when said cap element is rotated in one direction, and to said second, retracted position with said point protruding through said forward end opening when said cap element is rotated in the opposite direction, said barbs engaging said rearward terminations of said slots when said cap element is in said first covering position, the engagement of said barbs with said rearward terminations preventing removal of said cap element from said pen when said cap element is in said first covering position, said barbs being forwardly beveled for (i) permitting said cap element to be assembled over said barbs during assembly of said cap structure, and (ii) preventing inadvertent removal of said cap element when said cap element is in said first position, and C. a peripheral seat element affixed to said pen proximate to said cap element, for seatingly engaging said rear lip of said cap element when said cap element is in said retracted position, said rear lip and said peripheral seat element being radially dimensioned for collectively forming a selected radial interference fit when said cap element is in said retracted position, thereby enabling a user to hold said pen, for writing, by grasping said cap element.

* * * * *

UNITED STATES PATENT AND TRADEMARK OFFICE

CERTIFICATE OF CORRECTION

PATENT NO. : 4,780,016

DATED : 25 October 1988

INVENTOR(S) : JAE HOON KIM

It is certified that error appears in the above-identified patent and that said Letters Patent is hereby corrected as shown below:

Col. 4, line 58, "plurlaity" should be --plurality--.

Signed and Sealed this

Fourth Day of April, 1989

*Attest:*

*Attesting Officer*

DONALD J. QUIGG

*Commissioner of Patents and Trademarks*